US008448935B1

(12) United States Patent
Wu et al.

(10) Patent No.: US 8,448,935 B1
(45) Date of Patent: May 28, 2013

(54) PICKUP MECHANISM

(75) Inventors: Shao-Yang Wu, New Taipei (TW); Yueh-Shing Lee, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 0 days.

(21) Appl. No.: 13/468,581

(22) Filed: May 10, 2012

(30) Foreign Application Priority Data

Nov. 14, 2011 (CN) ..... 2011 2 0456895

(51) Int. Cl.
*B65H 3/06* (2006.01)

(52) U.S. Cl.
USPC ..... 271/117; 271/118

(58) Field of Classification Search
USPC ..... 271/117, 118
See application file for complete search history.

(56) References Cited

U.S. PATENT DOCUMENTS 7,398,970 B2 * 7/2008 Morimoto et al. ..... 271/117
7,571,905 B2 * 8/2009 Kim ..... 271/117
7,717,415 B2 * 5/2010 Kim et al. ..... 271/110
2002/0074711 A1 * 6/2002 Higaki ..... 271/117
2004/0021264 A1 * 2/2004 Gaarder et al. ..... 271/117
2005/0184449 A1 * 8/2005 Morimoto et al. ..... 271/118

* cited by examiner

*Primary Examiner* — David H Bollinger
(74) *Attorney, Agent, or Firm* — WPAT, P.C.; Anthony King

(57) ABSTRACT

A pickup mechanism includes a main frame, a supporting element mounted to the main frame, and a pickup module positioned in the main frame and including a pickup arm, a transmitting element, a separation element, a pickup element and a barrel element. The separation element includes a separation shaft and a separation roller. The pickup element includes a pickup shaft and a pickup roller. The separation roller and the pickup roller are restricted in the pickup arm. The transmitting element links the separation shaft and the pickup shaft. The pickup arm is pivoted at the separation shaft. The barrel element has a base portion pivotally mounted around the pickup shaft, and a stopping block. When the pickup module swings upward or downward, the barrel element is driven to rotate along with the pickup shaft to make the stopping block against the supporting element or apart from the supporting element.

7 Claims, 7 Drawing Sheets

PICKUP MECHANISM

BACKGROUND OF THE INVENTION

1. Field of the Invention

The present invention generally relates to a pickup mechanism, and more particularly to a pickup mechanism capable of picking up papers steadily.

2. The Related Art

Referring to FIGS. 1-4, a pickup mechanism includes a main frame 50, a pickup module 60, and at least one stopper element 70. The main frame 50 has an upper cover 51 and an input tray 52. The pickup module 60 positioned in the upper cover 51 of the main frame 50 includes a pickup arm 61, a separation element 63 and a pickup element 64 of which both are restrained in the pickup arm 61. The pickup arm 61 defines a first blocking block 611 and a second blocking block 612. The stopper element 70 is set on the upper cover 51 of the main frame 50 and located between the separation element 63 and the pickup element 64. The stopper element 70 has a blocking portion 72 located at a bottom thereof and a resisting portion 74 located at a top thereof. The resisting portion 74 may movably resist against the first blocking block 611 for supporting the pickup module 60, and also may resist against the second blocking block 612 for limiting a rotating angle of the stopper element 70.

When papers are prepared to be put on the input tray 52, the pickup element 64 together with the pickup arm 61 of the pickup module 60 is raised up to a constant level and the resisting portion 74 of the stopper element 70 resists against the first blocking block 611 for supporting the pickup module 60 so as to make sure the papers are put on the input tray 52 successfully to reach the stopper element 70. When the papers are put on the input tray 52 by user, a pushing force of the papers needs conquer a friction between the resisting portion 74 and the first blocking block 611 to push away the blocking portion 72 for allowing the pickup element 64 to swing downward to pick up the papers. However, when a single piece of paper is put on the input tray 52, the single piece of paper has the poor pushing force to fail to push away the blocking portion 72 that makes the pickup element 64 have no way of picking up the single piece of paper. Furthermore, when a larger external force than the friction acts on the pickup mechanism, even if the external force just can conquer the friction between the resisting portion 74 and the first blocking block 611, the pickup element 64 of the pickup module 60 is apt to slip downward to affect putting the papers on the input tray 52. As a result, the pickup mechanism fails to pick up the papers steadily.

SUMMARY OF THE INVENTION

An object of the present invention is to provide a pickup mechanism. The pickup mechanism includes a main frame, a supporting element mounted to the main frame, and a pickup module positioned in the main frame. The pickup module includes a pickup arm, a transmitting element, a separation element, a pickup element and a barrel element. The separation element includes a separation shaft and a separation roller mounted around the separation shaft. The pickup element includes a pickup shaft and a pickup roller mounted around the pickup shaft. The separation roller and the pickup roller are restricted in the pickup arm. The transmitting element links the separation shaft and the pickup shaft. The pickup arm is pivoted at the separation shaft to swing the pickup module upward or downward under a drive of a power source. The barrel element has a barrel-shaped base portion pivotally mounted around the pickup shaft of the pickup element. A side of the base portion extends outward to form a stopping block. When the pickup module swings upward or downward under the drive of the power source, the barrel element is also driven to rotate along with the pickup shaft so as to make the stopping block against the supporting element or apart from the supporting element.

As described above, when the pickup mechanism is in a status of preparing to put papers on an input tray, the power source drives the barrel element rotates upward along with the pickup shaft to make the stopping block exceed the top of supporting element. Therefore, the pickup module keeps being supported by the supporting element even if the pickup mechanism is crashed or shaken, for preventing the pickup module from swinging downward so that the papers can be effectively put under the pickup roller. Furthermore, when the pickup mechanism is in a status of picking up the papers loaded on the input tray, the barrel element is driven to rotate downward to make the stopping block of the barrel element be located under the supporting element, the pickup roller can be released freely to swing downward to pick up the papers loaded on the input tray. In this way, when a stack of papers or a single piece of paper is put on the input tray, it effectively prevents the stack of papers or the single piece of paper from needing conquer a force of the stopper element, accordingly, a drawback of prior art that the single piece of paper fails to push away the stopper element is also prevented. Therefore, it's convenient for putting the papers on the input tray so as to make the pickup mechanism pick up the papers steadily.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
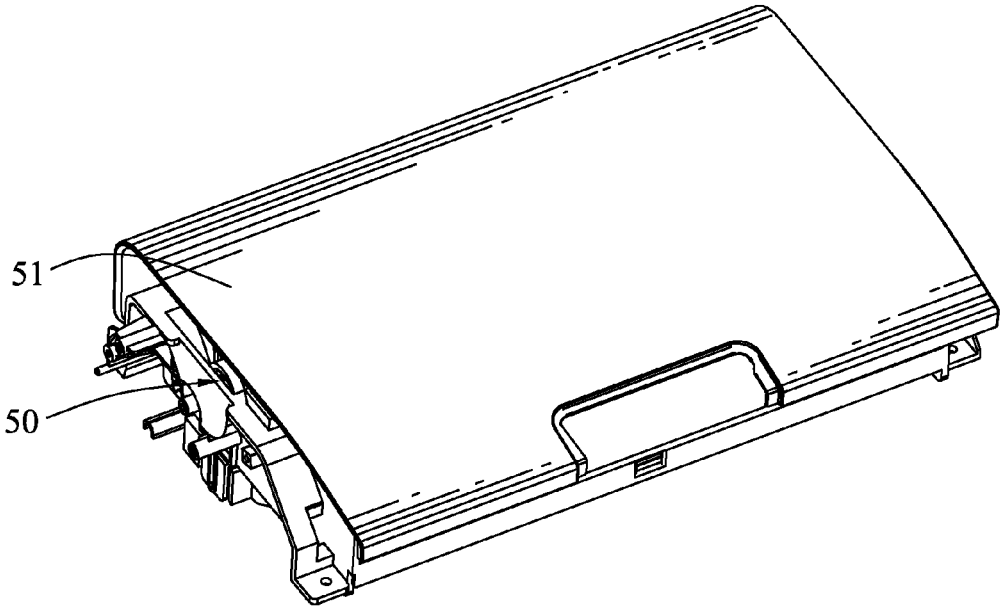
FIG. 1 (Prior Art)
FIG. 1 is a perspective view of a pickup mechanism in prior art.
Figure 2:
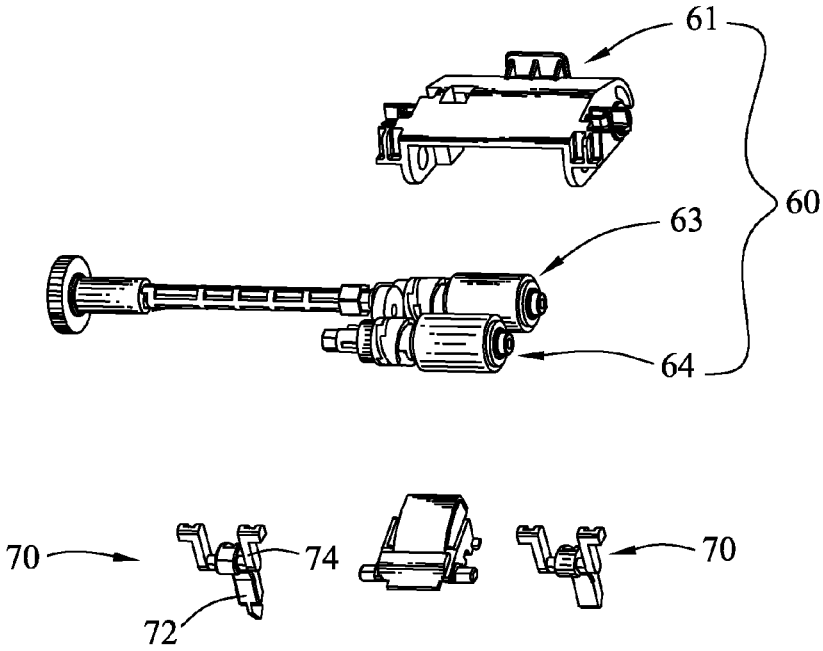
FIG. 2 (Prior Art)
FIG. 2 is a partially exploded view of the pickup mechanism of FIG. 1.
Figure 3:
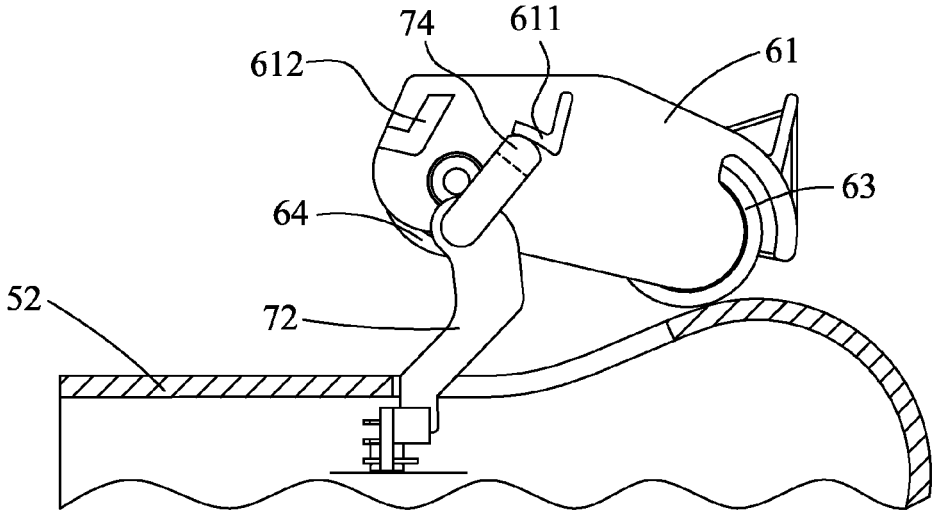
FIG. 3 (Prior Art)
FIG. 3 is a partially side-sectional view of a status of preparing for putting papers on an input tray of the pickup mechanism of FIG. 1.
Figure 4:
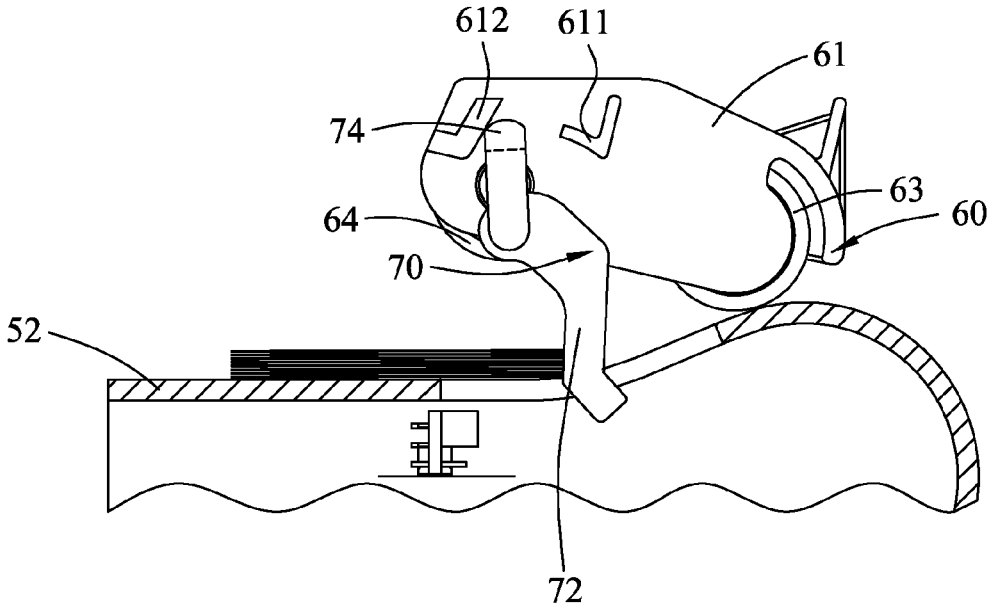
FIG. 4 (Prior Art)
FIG. 4 is another partially side-sectional view of a status of a pickup module preparing for picking up the papers on the input tray of the pickup mechanism of FIG. 1.
Figure 5:
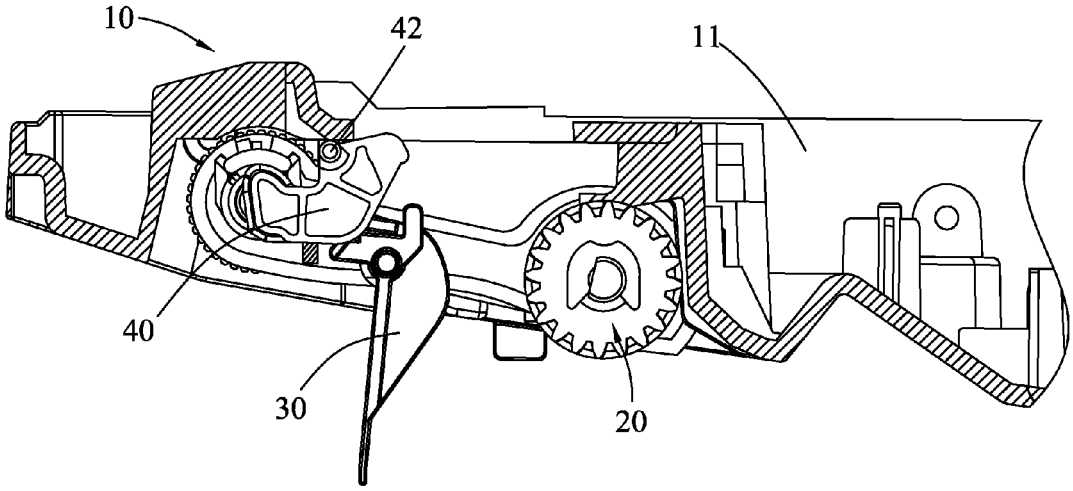
FIG. 5 is a partially side-sectional view of a pickup mechanism in accordance with the present invention.
Figure 6:
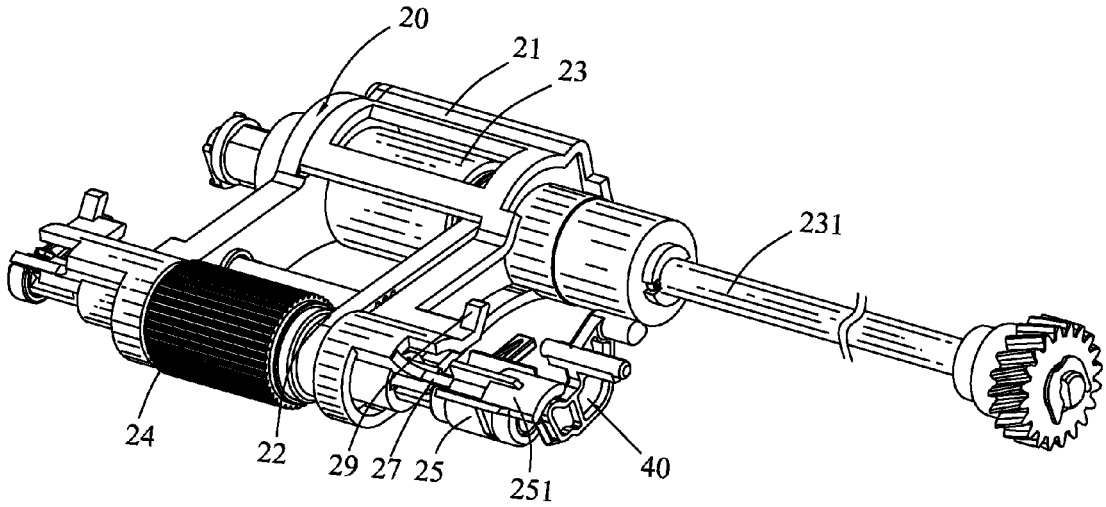
FIG. 6 is a perspective view of a pickup module of the pickup mechanism of FIG. 5.
Figure 9:
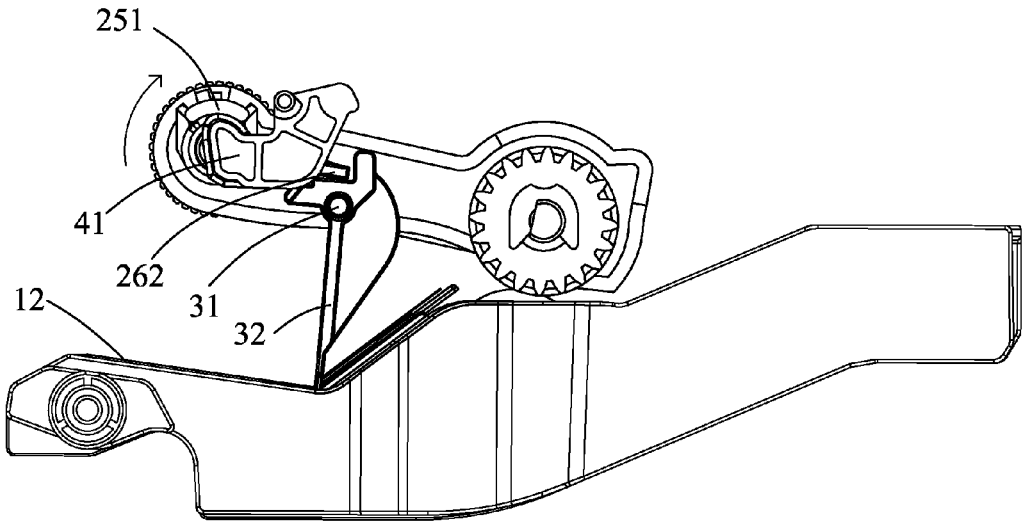
FIG. 9 is a side view of a rising status of the pickup module of the pickup mechanism of FIG. 5.

With reference to FIG. 5, FIG. 6 and FIG. 9, a pickup mechanism in accordance with the present invention is shown. The pickup mechanism includes a main frame 10, a pickup module 20, two stopper elements 30, at least a supporting element 40 and a paper detecting device (not shown).

Referring to FIG. 5, FIG. 6, FIG. 7 and FIG. 9, the main frame 10 has an upper cover 11 located at a top thereof and an input tray 12 located at a bottom thereof. The pickup module 20 positioned in the upper cover 11 of the main frame 10 includes a pickup arm 21, a transmitting element 22, a pickup element 24, a separation element 23, a barrel element 25 and a pushing element 26. The pickup element 24 is used for contacting and pulling out papers loaded on the input tray 12, and then transmitting the papers to the separation element 23. The pickup element 24 includes a pickup shaft 241 and a pickup roller 242 mounted around the pickup shaft 241. The separation element 23 can interact with a retard element (not shown) for separating one piece of paper from the pickup element 24 at one time, and pulling the one piece of paper into a downstream position of an inside of an Automatic Document Feeder (ADF) in which the pickup mechanism is used. The separation element 23 includes a separation shaft 231 and a separation roller 232 mounted around the separation shaft 231. The separation roller 232 and the pickup roller 242 are restricted in the pickup arm 21. The transmitting element 22 is a belt or a gear chain. The transmitting element 22 links the separation shaft 231 and the pickup shaft 241. The separation roller 232 and the pickup roller 242 are made of a material with a high friction coefficient, such as rubber. In addition, the separation roller 232 may be replaced by a separation belt and the pickup roller 242 may be replaced by a pickup belt.

One end of the separation shaft 231 is pivoted to the upper cover 11, and the other end of the separation shaft 231 is connected with a power source (not shown) to drive the pickup module 20. The pickup arm 21 is pivoted at the separation shaft 231 to swing the pickup module 20 clockwise upward or anticlockwise downward under a drive of the power source. In this embodiment, the power source includes a motor (not shown) and a plurality of gears (not shown). A motive power generated by the motor is transmitted by the gears to the separation shaft 231 to drive the separation roller 232 to rotate. Then the motive power is transmitted to the pickup shaft 241 by the separation shaft 231 on account of the separation shaft 231 connecting with the pickup shaft 241 by the transmitting element 22.

Figure 7:
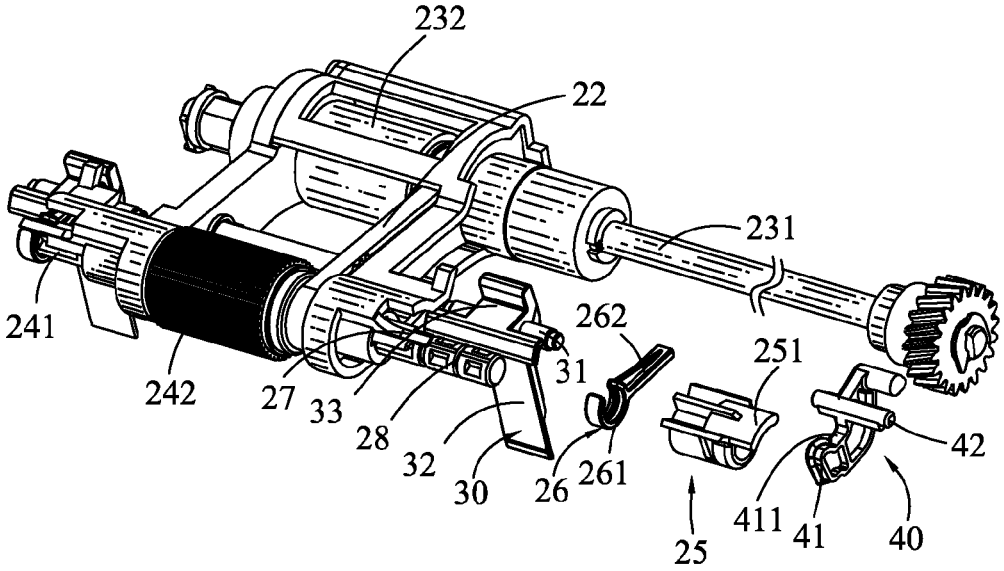
FIG. 7 is a partially exploded view of the pickup module, a stopper element and a supporting element of the pickup mechanism of FIG. 5.
Figure 8:
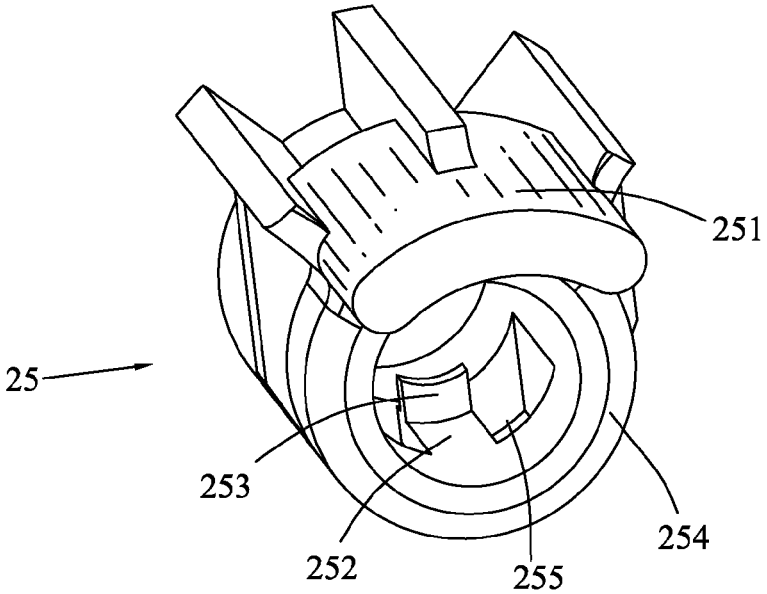
FIG. 8 is a barrel element of the pickup module of the pickup mechanism of FIG. 7.

Referring to FIG. 6, FIG. 7 and FIG. 8, one side of the pickup arm 21 has a blocking piece 27 disposed to one end of the pickup element 24 and a blocking block 29 disposed between the separation element 23 and the pickup element 24. A periphery of one end of the pickup shaft 241 of the pickup element 24 is concaved inward to form a ring-shaped sliding groove 28. The barrel element 25 has a barrel-shaped base portion 254. A side of the base portion 254 extends outward to form a stopping block 251. A portion of an inside of the base portion 254 opposite to the stopping block 251 defines an arc-shaped groove 255. A middle of one inner side of the groove 255 extends towards the other inner side of the groove 255 to define an elastic arm 252 of which a free end protrudes inward to form a sliding block 253. The base portion 254 is pivotally mounted around the one end of the pickup shaft 241 of the pickup element 24. The barrel element 25 rotates along with the pickup shaft 241 by a friction between the base portion 254 of the barrel element 25 and the pickup shaft 241. The friction between the barrel element 25 and the pickup shaft 241 can be provided by means of the elastic arm 252 of the barrel element 25, an elastic element (not shown) or damping oil (not shown). The sliding block 253 resists in the sliding groove 28 by an elastic force of the elastic arm 252 to generate the friction. The elastic element, such as a spring, is disposed between the barrel element 25 and the pickup shaft 241 to make the elastic element rub against the base portion 254 of the barrel element 25 and the pickup shaft 241 so as to generate the friction between the barrel element 25 and the pickup shaft 241. The damping oil is applied on the pickup shaft 241 and the inside of the base portion 254 of the barrel element 25 so as to generate the friction between the barrel element 25 and the pickup shaft 241.

Referring to FIG. 6 and FIG. 7, the pushing element 26 has an arc-shaped locating portion 261 and a pushing portion 262 extending outward from a free end of the locating portion 261. The locating portion 261 is pivoted around the pickup shaft 241 and located between the pickup roller 242 of the pickup element 24 and the barrel element 25. The blocking piece 27 projects into a gap of the locating portion 261. The locating portion 261 pivots the pickup shaft 241 to rotate to make two opposite ends of the locating portion 261 resist against the blocking piece 27 alternately so as to limit a rotation angle of the locating portion 261 of the pushing element 26.

Referring to FIG. 5, FIG. 6 and FIG. 7, each stopper element 30 which is set on the main frame 10 has a pivoting portion 31, a blocking portion 32 extending downward from a bottom of the pivoting portion 31, and a resisting portion 33 protruding upward from a top of the pivoting portion 31. The pivoting portion 31 is pivoted to the upper cover 11 of the main frame 10, and is located between separation element 23 and the pickup element 24 to make the stopper element 30 pivotally mounted to the main frame 10. Meanwhile, the stopper element 30 is located between the separation element 23 and the pickup element 24. When the stopper element 30 is hung down freely, the blocking portion 32 of the stopper element 30 blocks a leading edge of the input tray 12 for blocking the papers entering an inside of the pickup mechanism. The pushing portion 262 is brought along by the locating portion 261 of the pushing element 26 to rotate around the pickup shaft 241 so as to movably resist against the resisting portion 33.

Referring to FIG. 5, FIG. 6, FIG. 7 and FIG. 8, the supporting element 40 mounted to the main frame 10 has a fastening pillar 42 mounted to the upper cover 11 of the main frame 10 and adjacent to the barrel element 25, and a supporting portion 41 connecting with a bottom of the fastening pillar 42. A top of the supporting portion 41 defines an indentation portion 411. The stopping block 251 can be sustained by the indentation portion 411 of the supporting portion 41 for supporting the pickup module 20 when the pickup arm 21 is raised up. The barrel element 25 is capable of rotating clockwise upward along with the pickup shaft 241 to make the stopping block 251 against the indentation portion 411 of the supporting portion 41 for supporting the pickup module 20 so as to keep the pickup mechanism at a status of preparing for putting the papers on the input tray 12. The barrel element 25 is capable of rotating anticlockwise downward along with the pickup shaft 241 to make the stopping block 251 apart from the supporting portion 41 for releasing the pickup module 20 freely so as to make the pickup module 20 becoming a status of beginning picking up the papers on the input tray 12.

The paper detecting device is pivoted to the upper cover 11 of the main frame 10 for detecting whether there is any paper on the input tray 12.

Referring to FIGS. 5-12, the working process of the pickup mechanism is described as following. When the pickup mechanism completes a round of feeding action, before next round that the papers put on the input tray 12, there is no paper on the input tray 12. The paper detecting device detects there is no paper loaded on the input tray 12. At this moment, the pickup element 24 together with the pickup arm 21 pivots the separation shaft 231 to swing clockwise upward under the drive of the power source, the stopping block 251 of the barrel element 25 against a top side of the supporting portion 41. So when the pickup module 20 bears a suddenly external force or the pickup module 20 is shaken, the supporting portion 41 can resist against a bottom of the stopping block 251 and prop up the stopping block 251. The barrel element 25 is also driven to rotate clockwise upward along with the pickup shaft 241 until the stopping block 251 touches a side of the supporting portion 41 to stop rotating, the pickup element 24 together with the pickup arm 21 goes on rising until the stopping block 251 exceeds the top of the supporting portion 41 and passes across the top of the supporting portion 41, at this moment, the barrel element 25 continues rotating clockwise upward until the stopping block 251 is against the indentation portion 411 of the supporting portion 41. In that case, the pickup module 20 is raised up to a constant level, and the pickup module 20 keeps being supported by the supporting portion 41 even if the pickup mechanism is crashed or shaken, for preventing the pickup module 20 from swinging downward. And the pickup mechanism is in a status of preparing to put the papers on the input tray 12 so that the papers can be effectively put under the pickup roller 242 to make the pickup mechanism pick up the papers steadily.

Referring to FIGS. 5-12 again, after the papers are put on the input tray 12, a signal is sent to the pickup mechanism by pressing button, computer or other ways to make the pickup mechanism be in a status of picking up the papers loaded on the input tray 12, the power source drives the pickup module 20 together with the pickup arm 21 pivoting the separation shaft 231 to swing anticlockwise downward to bring along the pickup element 24 of the pickup module 20 swing anticlockwise downward, the barrel element 25 is also driven to rotate anticlockwise downward along with the pickup shaft 241 so as to make the stopping block 251 of the barrel element 25 apart from the supporting portion 41. When the barrel element 25 is driven to rotate anticlockwise downward to make the stopping block 251 of the barrel element 25 be located under the supporting portion 41, the pickup roller 242 can be released freely to swing downward to pick up the papers loaded on the input tray 12. Meanwhile, the pickup shaft 241 of the pickup element 24 drives the pushing portion 262 of the pushing element 26 to apart from the resisting portion 33 of the stopper element 30. The blocking block 29 presses a top side of the stopper element 30 for making the blocking portion 32 rotate with the stopper element 30, so that the stopper element 30 can be pushed away by the papers from the leading edge of the input tray 12 easily. In this way, when a stack of papers or a single piece of paper is put on the input tray 12, it effectively prevents the stack of papers or the single piece of paper from needing conquer a force of the stopper element 30, accordingly, a drawback of prior art that the single piece of paper fails to push away the stopper element 30 is also prevented. Therefore, it's convenient for putting the papers on the input tray 12 so as to make pickup element 24 of the pickup mechanism pick up the papers steadily. When the pickup roller 242 contacts the papers, the power source drives the pickup roller 242 to roll on the papers so as to pull out the papers from the input tray 12, and then the one piece of paper is pulled into the downstream position of the inside of ADF by the separation roller 232 of the separation element 23.

Referring to FIG. 6, FIG. 7, FIG. 8, FIG. 9 and FIG. 10, after all the papers are fully pulled into and passes through the pickup mechanism, and there is no paper on the input tray 12, the paper detecting device detects there is no paper on the input tray 12. Again, the pickup element 24 together with the pickup arm 21 pivots the separation shaft 231 to swing clockwise upward under the drive of the power source. The barrel element 25 is also driven to rotate clockwise upward along with the pickup shaft 241 until the stopping block 251 touches the side of the supporting portion 41 to stop rotating, the pickup element 24 together with the pickup arm 21 goes on rising until the stopping block 251 exceeds the top of the supporting portion 41 and passes across the top of the supporting portion 41, at this moment, the barrel element 25 continues rotating clockwise upward until the stopping block 251 is against the indentation portion 411 of the supporting portion 41. In that case, the pickup module 20 is raised up to the constant level, the pickup mechanism returns to the status of preparing to put the papers on the input tray 12 so as to facilitate putting the papers on the input tray 12 in the next round.

Figure 10:
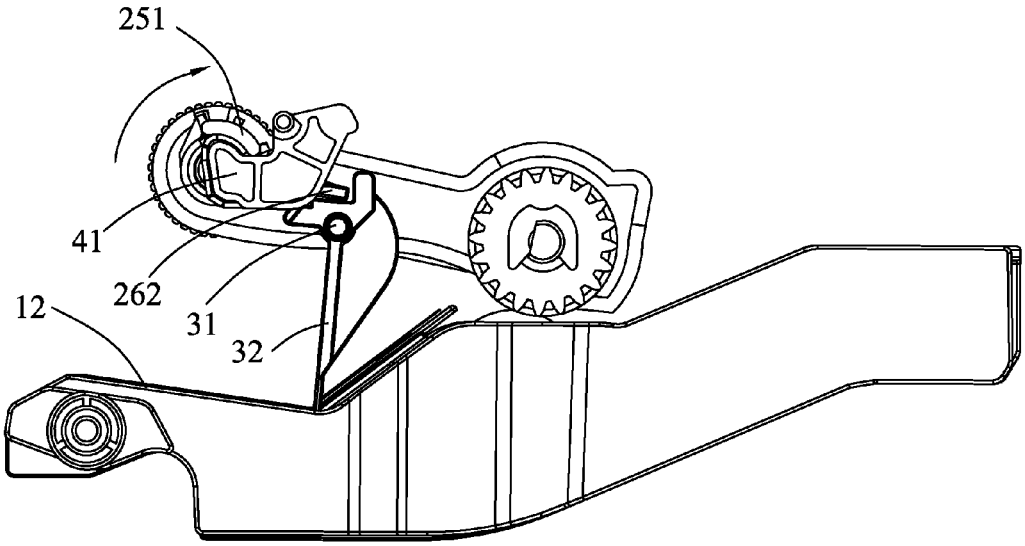
FIG. 10 is a side view of a status of preparing for putting papers on an input tray of the pickup mechanism of FIG. 5.
Figure 11:
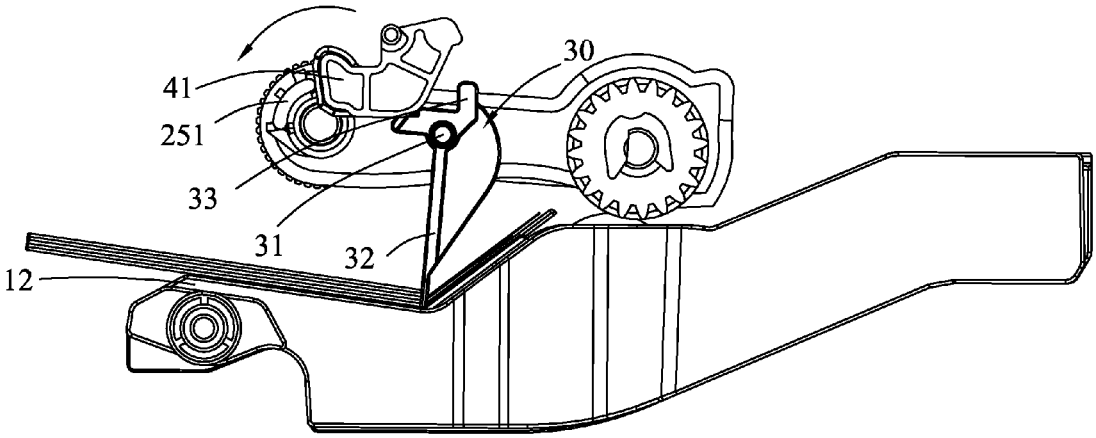
FIG. 11 is a side view of a status of the pickup module preparing for picking up the papers on the input tray of the pickup mechanism of FIG. 5.
Figure 12:
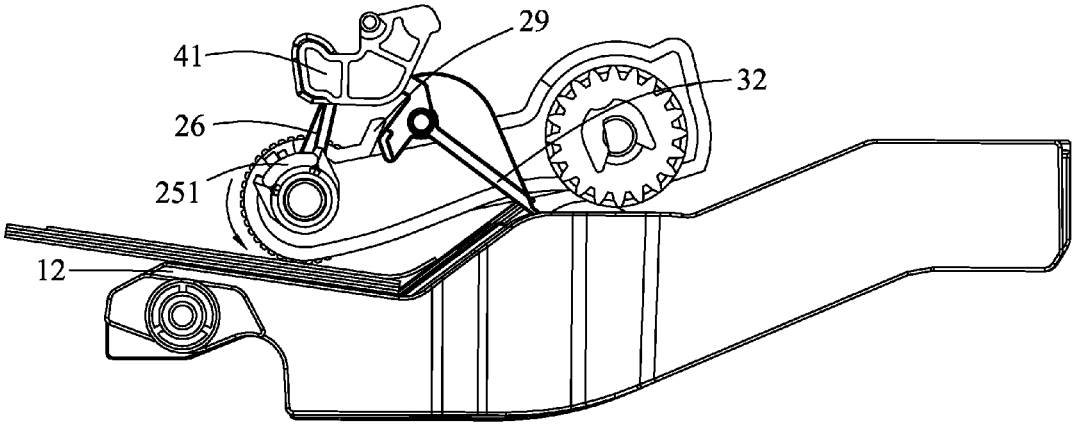
FIG. 12 is a side view of a status of the pickup module picking up the papers on the input tray of the pickup mechanism of FIG. 5.

Referring to FIG. 7, FIG. 8 and FIG. 10, when the pickup module 20 is raised up to the constant level, the stopping block 251 is sustained by the indentation portion 411 of the supporting portion 41 for supporting the pickup module 20 so as to block the barrel element 25 from rotating clockwise upward because a blocking force between the supporting portion 41 and the stopping block 251 of the barrel element 25 is larger than the friction between the barrel element 25 and the pickup shaft 241.

As described above, when the pickup mechanism is in the status of preparing to put the papers on the input tray 12, the power source drives the barrel element 25 rotates clockwise upward along with the pickup shaft 241 to make the stopping block 251 exceed the top of the supporting portion 41 of supporting element 40. Therefore, the pickup module 20 keeps being supported by the supporting element 40 even if the pickup mechanism is crashed or shaken, for preventing the pickup module 20 from swinging downward so that the papers can be effectively put under the pickup roller 242. Furthermore, when the pickup mechanism is in the status of picking up the papers loaded on the input tray 12, the barrel element 25 is driven to rotate anticlockwise downward to make the stopping block 251 of the barrel element 25 be located under the supporting portion 41, the pickup roller 242 can be released freely to swing downward to pick up the papers loaded on the input tray 12. In this way, when a stack of papers or a single piece of paper is put on the input tray 12, it effectively prevents the stack of papers or the single piece of paper from needing conquer a force of the stopper element 30, accordingly, the drawback of prior art that the single piece of paper fails to push away the stopper element 30 is also prevented. Therefore, it's convenient for putting the papers on the input tray 12 so as to make the pickup mechanism pick up the papers steadily.

What is claimed is:

1. A pickup mechanism, comprising:

a main frame;

a supporting element mounted to the main frame; and a pickup module positioned in the main frame, and including a pickup arm, a transmitting element, a separation element, a pickup element and a barrel element, the separation element including a separation shaft and a separation roller mounted around the separation shaft, the pickup element including a pickup shaft and a pickup roller mounted around the pickup shaft, the separation roller and the pickup roller being restricted in the pickup arm, the transmitting element linking the separation shaft and the pickup shaft, the pickup arm pivoted at the separation shaft to swing the pickup module upward or downward under a drive of a power source, the barrel element having a barrel-shaped base portion pivotally mounted around the pickup shaft of the pickup element, a side of the base portion extending outward to form a stopping block, wherein when the pickup module swings upward or downward under the drive of the power source, the barrel element is also driven to rotate along with the pickup shaft so as to make the stopping block against the supporting element or apart from the supporting element.

2. The pickup mechanism as claimed in claim 1, wherein the barrel element rotates along with the pickup shaft by a friction between the barrel element and the pickup shaft.

3. The pickup mechanism as claimed in claim 2, wherein an inside of the base portion of the barrel element defines the elastic arm, a periphery of one end of the pickup shaft of the pickup element is concaved inward to form a ring-shaped sliding groove, a free end of the elastic arm protrudes inward to form a sliding block resisting in the sliding groove by an elastic force of the elastic arm to generate the friction.

4. The pickup mechanism as claimed in claim 1, further comprising a stopper element which is set on the main frame and located between the separation element and the pickup element, the stopper element having a blocking portion for blocking papers entering an inside of the pickup mechanism.

5. The pickup mechanism as claimed in claim 1, wherein the supporting element has a supporting portion, the stopping block can be sustained by the supporting portion for supporting the pickup module when the pickup arm is raised up.

6. The pickup mechanism as claimed in claim 1, wherein the separation roller and the pickup roller are made of a material with a high friction coefficient, such as rubber.

7. The pickup mechanism as claimed in claim 1, wherein the transmitting element is a belt or a gear chain.

* * * * *